US005767671A

United States Patent [19]

McCoy et al.

[11] Patent Number: 5,767,671

[45] Date of Patent: Jun. 16, 1998

[54] METHOD OF TESTING THE LIFELINE OF COILED TUBING

[75] Inventors: Terry H. McCoy, Duncan, Okla.; Charles F. VanBerg, Jr., Arlington, Tex.

[73] Assignee: Halliburton Company, Duncan, Okla.

[21] Appl. No.: 638,065

[22] Filed: Apr. 25, 1996

[51] Int. Cl.[6] ..... G01N 27/82; G01R 33/12

[52] U.S. Cl. ..... 324/209; 324/238; 324/262

[58] Field of Search ..... 324/209, 219, 324/220, 224, 226, 234, 236, 237, 238, 239, 240, 241, 242, 243, 262; 364/480, 481, 550, 551.01, 554; 73/760

[56] References Cited

U.S. PATENT DOCUMENTS

| | | | |
|---|---|---|---|
| 3,427,872 | 2/1969 | Leep et al. | 73/88.5 |
| 4,352,065 | 9/1982 | Rogachev et al. | 324/238 |
| 4,408,160 | 10/1983 | King et al. | 324/209 |
| 4,634,976 | 1/1987 | Tiitto | 324/240 |
| 4,689,558 | 8/1987 | Ruuskanen et al. | 324/209 |
| 4,763,274 | 8/1988 | Junher et al. | 324/220 |
| 4,881,030 | 11/1989 | Stuecker et al. | 324/209 |
| 5,109,195 | 4/1992 | Allison et al. | 324/235 |
| 5,134,368 | 7/1992 | Otaka et al. | 324/224 |

OTHER PUBLICATIONS

Abstract from *Chemical Abstracts* and full article entitled "Detection of plastic deformation during fatigue of mild steel by the measurement of Barkhausen noise,"L. P. Karjalainen and M. Moilanen, *NDT International*, pp. 51–55 (Apr. 1979).

Abstract from *Chemical Abstracts* and full article entitled "The influence of cyclic stressing on the Barkhausen effect in polycrystalline iron," P. Kettunen and P. Ruuskanen, Scandinavian J. of Metallurgy, pp. 112–114 (1979).

Sas–Jaworsky, A.: "Coiled Tubing—Operations and Service," World Oil, Nov. and Dec. 1991 (Parts 1 and 2).

Avakov, V.A., Foster, J.C. and Smith, E.J.: "Coiled Tubing Life Prediction," Offshore Technology Conference Paper No. 7325, Houston, TX, May 1993.

Newman, K.R. and Newburn, D.A.: "Coiled Tubing Life Modeling," Society of Petroleum Engineers Paper No. 22820, SPE Annual Technical Conference, Proceedings, Dallas, TX, Oct. 1991.

Kane, R.D. and Cayard, M.S.: "Factors Affecting Coiled Tubing Serviceability,"Petroleum Engineer International, Jan. 1993.

Carrigan, M. and Gray, B.: "Determining the working life of a coiled tubing string" (prior to Mar. 1995).

Newman, K.R.: "Coiled Tubing Pressure and Tension Limits," Society of Petroleum Engineers Paper No. 23131, Offshore Europe Conference, Aberdeen, Scotland, Sep. 1991.

Quality Tubing, Inc., "Coiled Tubing Fatigue Machine" (prior to Mar. 1995).

*Primary Examiner*—Walter E. Snow

*Attorney, Agent, or Firm*—Stephen R. Christian; E. Harrison Gilbert, III

[57] ABSTRACT

To test coiled tubing, at least one test is performed on a coiled tubing that has been used, such as in an oil or gas well. Performing such test includes obtaining a specific output data event (e.g., a nondestructive evaluation test readout) for the used coiled tubing. The specific output data event is compared with a predetermined sequence of output data events (e.g., a collection of data defining a "lifeline" for the coiled tubing) for determining where the sequence and the specific output data event correspond. A coiled tubing status indication is generated in response to where the specific output data event corresponds with the sequence as a measure of a point in the useful life of the used coiled tubing.

22 Claims, 4 Drawing Sheets

METHOD OF TESTING THE LIFELINE OF COILED TUBING

BACKGROUND OF THE INVENTION

This invention relates to testing coiled tubing used in wells, such as oil or gas wells, to determine where in the life of the tubing its current condition is.

The operational concept of a coiled tubing system is to run a continuous string of small diameter tubing into a well to perform specific well servicing operations. Coiled tubing can be used, for example, for electric wireline logging and perforating, drilling, conveying tools, wellbore cleanout, fishing, setting and retrieving tools, displacing fluids, and transmitting hydraulic power into the well.

Coiled tubing is a continuous length flexible product made from steel strip. The strip is progressively formed into tubular shape and a longitudinal seam weld is made by electric resistance welding (ERW) techniques. The product has a relatively thin wall (e.g., from 0.067 to 0.203 inches (1.70–5.16 mm)) defining a cylindrical tube having an axial channel throughout its length. Its length is typically several thousand feet.

A coiled tubing is typically mounted on a reel which is carried to and from a well site on a truck. In use, the coiled tubing is fed off the reel, over a gooseneck, and into the well through a coiled tubing injector. This bends the tubing, thereby creating severe flexural strains and plastic deformation of the tubing. For coiled tubing used in oil or gas wells, such plastic deformation can include strains typically within the range of about 0.01 to about 0.02, but can be higher depending on the coiled tubing size and bend radius utilized. In addition, internal pressure is applied through the tubing as it cycles in and out of the well.

When the tubing is in the well, it is exposed to the downhole environment. In an oil or gas well, this includes high temperatures and fluids under high pressure that act on the tubing. Additionally, fluids can be pumped down through the axial channel of the tubing from the surface, thereby exerting pressure on the tubing wall from inside.

These and other forces and environmental conditions create a complex of mechanical as well as corrosive effects on the tubing which may be known generally but impractical, if not impossible, to determine specifically along the length of the coiled tubing as it is uncoiled, loaded, fed into a well, used, withdrawn from the well, unloaded and re-coiled. To try to determine when a coiled tubing should be taken out of service because of degradation brought about by these effects, numerical models have been created to estimate how many cycles a particular type of coiled tubing can be used. Once an estimate has been determined, data is obtained when the coiled tubing is used so that the number of cycles of actual use can be known. However, this technique does not account for specific conditions of a particular coiled tubing or of all the environments in which it is used, other than possibly by way of some selected general adjustment factor (e.g., some factor assumed for a given corrosive environment). Thus, plasticity and fatigue models will, of necessity, be only an estimate of the actual condition of a particular coiled tubing string and must additionally include safety factors to insure that the coiled tubing string is retired from service before catastrophic failure occurs. Premature retirement of the coiled tubing string results in economic losses. On the other hand, coiled tubing degradation is cumulative which will ultimately lead to the point of catastrophic failure (complete breaking or severing) if the coiled tubing is used long enough.

To avoid catastrophic failure, it is not uncommon for the coiled tubing to be removed from service at 50% of predicted life based on numerical model predictions. This may result in premature retirement causing economic loss. For example if twenty-five 15,000 ft. coiled tubings are retired at 50% of their useful lives each year at a cost of $2/foot, the annual cost is $750,000. If a more precise analysis of the coiled tubings could be made, such as might enable use up to 75% of useful life (i.e., a 50% increase over the foregoing example), coiled tubing costs would be reduced (by $375,000 relative to the foregoing example) without increasing risk of catastrophic failure due to overextended use of the coiled tubing.

In view of the foregoing, there is the need for a method of testing coiled tubing whereby a relative stage in the useful life of the coiled tubing can be determined not only to prevent or decrease the possibility of catastrophic failure occurring due to fatigue but also to prevent premature retirement of the coiled tubing.

SUMMARY OF THE INVENTION

The present invention overcomes the above-noted and other shortcomings of the prior art by providing a novel and improved method of testing coiled tubing. By using the present invention, coiled tubing can be tested to prevent or reduce both the chance of catastrophic failure and the premature retirement of the coiled tubing.

The method of testing coiled tubing in accordance with the present invention comprises performing at least one test on a coiled tubing that has been used. Performing such test includes obtaining a specific output data event (e.g., a nondestructive evaluation test readout) for the used coiled tubing. The method further comprises comparing the specific output data event with a predetermined sequence of output data events (e.g., a collection of data defining a "lifeline" for the coiled tubing) for determining where the sequence and the specific output data event correspond. The method still further comprises generating a coiled tubing status indication in response to where the specific output data event corresponds with the sequence as a measure of a point in the useful life of the used coiled tubing.

In a particular implementation, the present invention provides a method of testing coiled tubing comprising determining a lifeline for a selected type of coiled tubing made of a known material and having a nominal diameter and wall thickness. This lifeline is determined by (a1) using a selected coiled tubing of the selected type such that the selected coiled tubing undergoes stress and strain in response to forces encountered in using a coiled tubing at an oil or gas well; (a2) after step (a1), performing at least one nondestructive evaluation test on the selected coiled tubing to obtain an output data event; (a3) recording the output data event; (a4) repeating steps (a1) through (a3) throughout a lifetime of the selected coiled tubing so that a sequence of recorded output data events is obtained for the selected coiled tubing; (a5) repeating steps (a1) through (a4) for a plurality of selected coiled tubings of the selected type so that a plurality of sequences of recorded output data events are obtained; and (a6) defining the lifeline for the selected type of coiled tubing in response to the plurality of sequences of recorded output data events. The overall method further comprises steps of: (b) performing the at least one test on a coiled tubing of the selected type, including obtaining a specific output data event for the coiled tubing; (c) comparing the specific output data event with the defined lifeline for determining where the defined lifeline and the specific output data event correspond; and (d) generating a coiled tubing status indication in response to where the specific output data event corresponds with the defined lifeline as a measure of a point in the useful life of the coiled tubing of step (b).

Therefore, from the foregoing, it is a general object of the present invention to provide a novel and improved method of testing coiled tubing. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a flow chart of a program for implementing the present invention, such as through use in the system of FIG. 4.

DETAILED DESCRIPTION OF PREFERRED EMBODIMENTS

Figure 1:
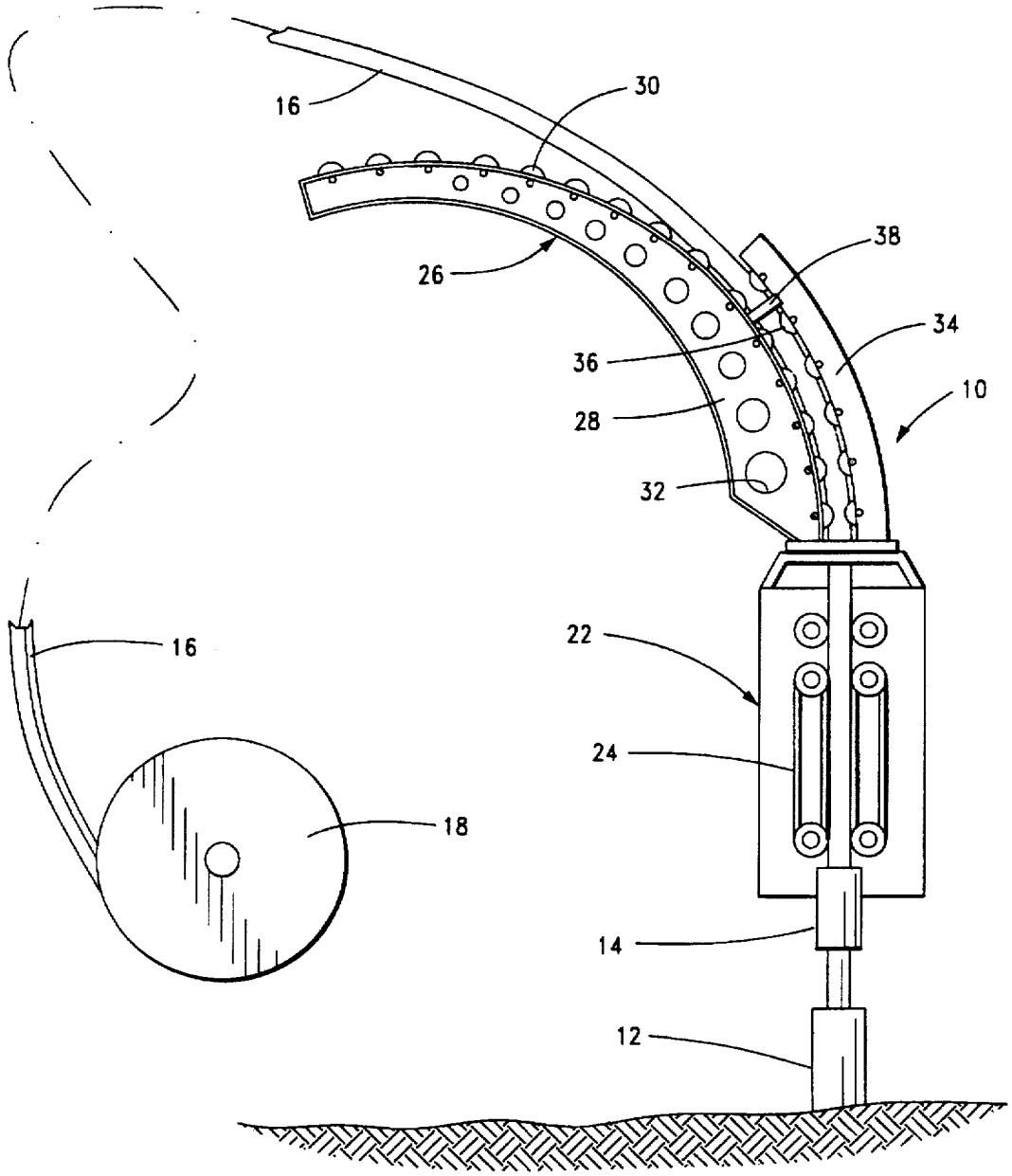
FIG. 1 shows a side elevational schematic view of a coiled tubing and a coiled tubing injector used at the mouth of a well.
Figure 2:
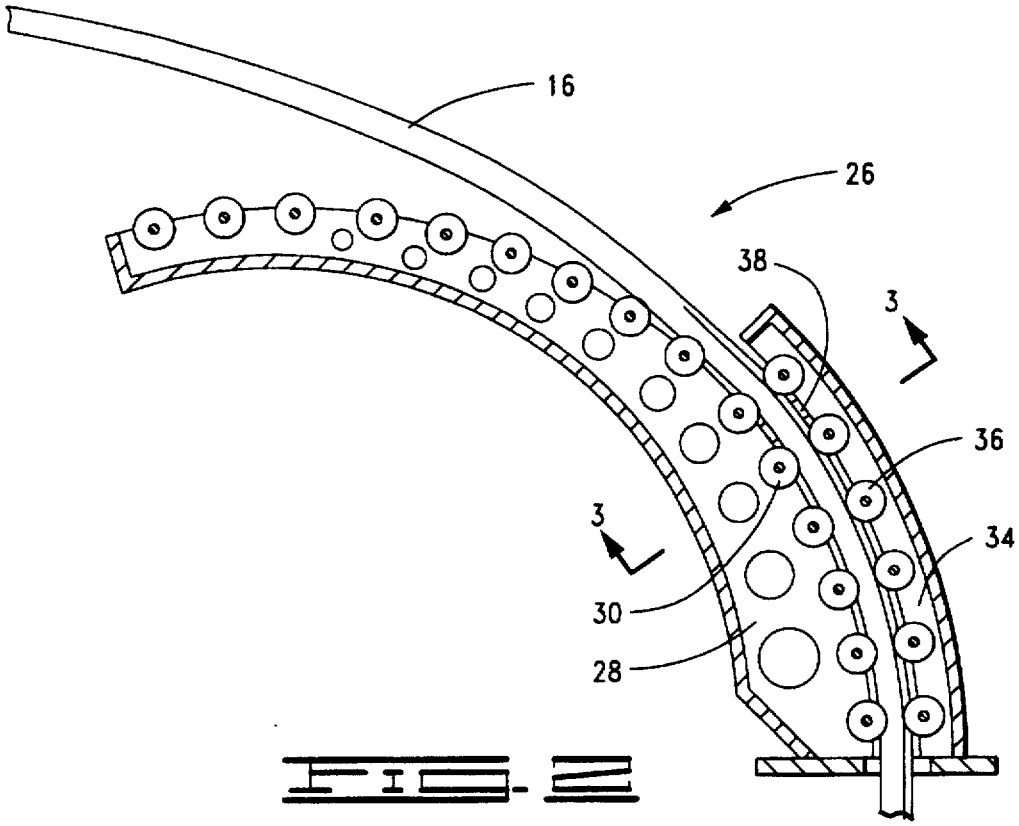
FIG. 2 is a vertical cross section of a gooseneck tubing guide apparatus of the tubing injector of FIG. 1.
Figure 3:
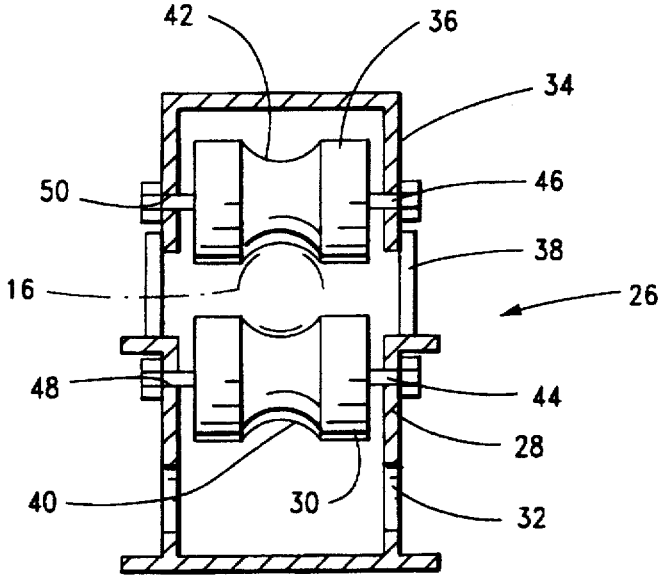
FIG. 3 is a cross section taken along line 3—3 in FIG. 2.

Referring now to the drawings, and more particularly to FIGS. 1–3, a coiled tubing injector assembly for use with an oil or gas well is shown and generally designated by the numeral 10. The assembly 10 is positioned over a wellhead 12 which is provided with a stuffing box or lubricator 14. Coiled tubing 16 is provided to assembly 10 on a large drum or reel 18, and typically is several thousand feet in length. The tubing is in a yielded and coiled state when supplied from drum or reel 18. The tubing has a natural, or residual radius of curvature when it is in its relaxed state after being spooled from the reel.

As specific examples of coiled tubing 16, Halliburton Energy Services generally uses three grades of electric resistance welded tubing respectively having minimum yield strengths of 70, 80 and 100 ksi (kilopounds per square inch). The material used for the coiled tubing is low carbon low alloy steel, similar to ASTM A606 or A607.

The well in which a selected coiled tubing is to be used is typically pressure isolated. That is, entry of tubing 16 into the well must be through stuffing box 14 which enables the tubing, which is at atmospheric pressure, to be placed in the well which may operate at higher pressures. Entry into the well requires that the tubing be substantially straight. To this end, the assembly 10 incorporates a coiled tubing injector apparatus 22 that is constructed with drive chains which carry blocks adapted for gripping tubing 16. The details of drive chains and blocks, identified in FIG. 1 by the reference numeral 24, are known in the art. See for example, U.S. Pat. No. 5,094,340 entitled "GRIPPER BLOCKS FOR REELED TUBING INJECTORS," the details of which are incorporated herein by reference.

A gooseneck tubing guide 26 is attached to the upper end of coiled tubing injector apparatus 22. Typically, tubing guide 26 is pivotable about a vertical axis with respect to the injector 22 positioned below as illustrated in FIG. 1. Gooseneck tubing guide 26 includes a curvilinear first or bottom frame 28 having a plurality of first or bottom rollers 30 rotatably disposed thereon. Bottom frame 28 includes a plurality of lightening holes 32 therein.

Spaced from bottom frame 28 is a second or top frame 34 which has a plurality of second or top rollers 36 rotatably disposed thereon. Top rollers 36 generally face at least some of bottom rollers 30. In the embodiment illustrated, the length of curvilinear top frame 34 is less than that of curvilinear bottom frame 28. The distal end of top frame 34 is attached to bottom frame 28 by a bracket 38.

Referring now to FIG. 3, bottom rollers 30 have a circumferential groove 40 therein, and top rollers 36 have a similar circumferential groove 42 therein. Facing rollers 30 and 36 are spaced such that tubing 16 is generally received in grooves 40 and 42 to guide and straighten the tubing as it enters coiled tubing injector apparatus 22 of assembly 10. The gooseneck tubing guide thus bends and straightens the tubing 16 into the vertical, or injection portion.

Bottom rollers 30 are supported on first shafts 44, and similarly, top rollers 36 are supported on second shafts 46. Shafts 44 are disposed through a plurality of aligned pairs of holes 48 in bottom frame 28. Shafts 46 are disposed through holes 50 in top frame 34. Rollers 30 and 36 are supported on shafts 44 and 46, respectively, by bearings (not shown).

In its use with the coiled tubing injection assembly 10, the coiled tubing 16 undergoes bending and straightening each time it is injected and/or withdrawn from the well. As a result, the coiled tubing 16 undergoes bending fatigue at high strain amplitudes. More generally, the coiled tubing 16 is subjected to mechanical and pressure forces during the deployment sequence and while in the work position in the well. The continuous length of tubing experiences plastic deformation before entering the wellbore during the process of unwinding from the reel and passing through the surface machinery. The plastic strains superposed with high tangential stresses introduces the low-cycle fatigue failure mechanism. The loading conditions inside the well are also complex (but not in the plastic strain regime) and of a dynamic nature. Examples of uses which impose such degrading conditions on coiled tubing include drilling with a drill bit connected to the coiled tubing, removing downhole restrictions using high pressure fluid pumped through the coiled tubing and attached nozzles, and using coiled tubing in sour wells (i.e., ones containing $H_2S$). Coiled tubing subjected to these operating conditions has a finite life.

Degrading factors such as the foregoing occur repeatedly throughout the life of the coiled tubing as it is used repeatedly over a period of time in different oil or gas wells. As a result of this, the coiled tubing undergoes a cumulative process of degrading. The synergistic effects of various mechanical and environmental factors acting on a particular coiled tubing at any given time or in any given well may not be well defined and it is therefore difficult to make meaningful life predictions using only numerical modeling techniques.

Because of the uncertain but significant cyclical degradation occurring in a given coiled tubing, the present invention provides a method of determining where in the useful life of a particular coiled tubing it is regardless of the lack of knowledge about the specific forces, conditions and cycles acting upon the given coiled tubing. A system for use in implementing the method is represented in FIG. 4.

Figure 4:
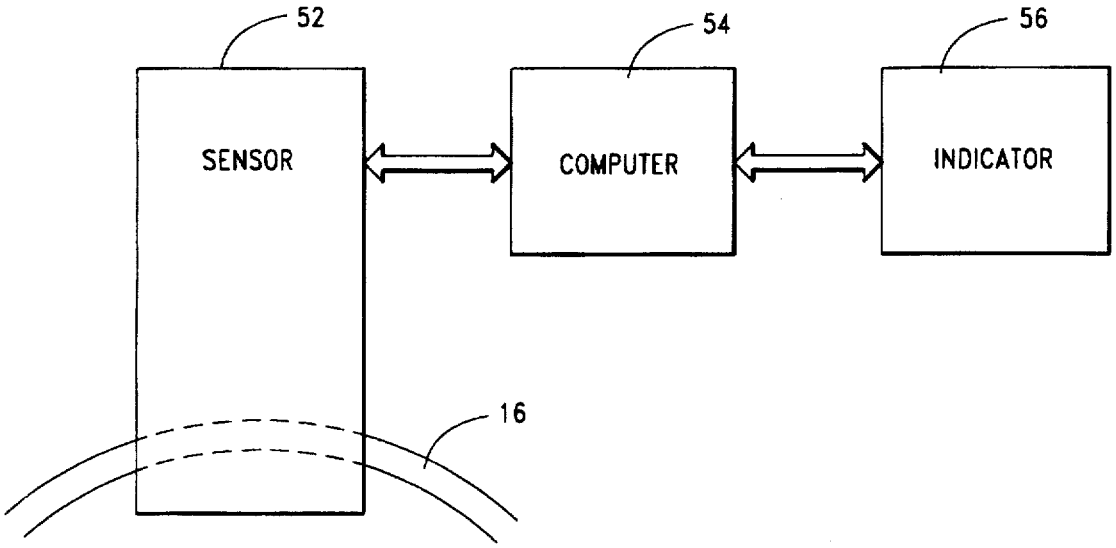
FIG. 4 is a block diagram of a system for performing the method of the present invention.

The system generally includes a sensor 52, a computer 54 and an indicator 56 interconnected in a suitable manner to obtain information about the condition of the coiled tubing 16 to which the sensor 52 is applied as illustrated in FIG. 4.

The sensor 52 senses one or more characteristics or parameters of the coiled tubing at a particular location, or along a section of, or along the entire length of the coiled tubing undergoing a test. For a given point in time, the sensor 52 obtains a specific output data event representative of at least one parameter correlated to the condition of the coiled tubing.

The computer 54 is used to compare the specific output data event obtained via the sensor 52 with a predetermined sequence of output data events for determining where the sequence and the specific output data event correspond. The predetermined sequence of output data events is obtained either from the particular coiled tubing under examination or from others used to define a "lifeline" or "fingerprint" applicable to the type of coiled tubing 16 represented in FIG. 4 as undergoing examination.

Once the comparison has been made, the indicator 56 is used for generating a coiled tubing status indication in response to where the specific output data event corresponds with the predetermined sequence of output data events as a measure of a point in the useful life of the coiled tubing. The indicator 56 can be, for example, a display screen driven to graphically or numerically or alphabetically display the result of the functions performed by the sensor 52 and the computer 54.

In a particular implementation of the foregoing, the system should have the capability to measure eddy current, differential flux leakage, magnetic hysteresis and Barkhausen signals. From these measurements, dents, wall thinning, cracks and fatigue lifetime of the tubing may be detected or estimated.

Specific equipment to obtain at least one of the foregoing data can be of any suitable type known in the art for taking the desired measurements. For example, known types of sensors used for obtaining the aforementioned signals and a programmed personal computer with display can be used. One contemplated source is Ames Magnetics, Inc. of Ames, Iowa.

Particular coiled tubing and test apparatus are neither the present invention nor limiting of how the method which is the present invention can be implemented. This method will now be described.

The method of the present invention includes testing a particular coiled tubing to determine one or more identifiable parameters, referred to herein as a specific output data event, and from that determining where the coiled tubing is in its anticipated useful life. This includes comparing the particular specific output data event to a predetermined "lifeline" or "fingerprint" applicable to the particular type of coiled tubing under examination.

To determine the lifeline or fingerprint, at least one test is performed on at least one test coiled tubing over at least a portion of a time period during which the test coiled tubing has been subjected to tensile, compressive and shear forces acting on the coiled tubing. This at least one test provides a sequence of output data events such that the sequence correlates to a progressive degradation of the test coiled tubing. Typically, a plurality of test coiled tubings are tested and an average sequence of output data events is determined. It is possible, however, that the predetermined sequence of output data events can be obtained from the coiled tubing itself, such as by tracking the initial magnetic history of the coiled tubing and extrapolating a useful lifeline or fingerprint and then comparing that against some subsequent test event taken on the coiled tubing. Preferably, the at least one test includes a magnetic nondestructive evaluation test. More specific examples of applicable tests include: eddy current, differential flux leakage, magnetic hysteresis, Barkhausen signals (peak amplitude, count rate and rms signal level). Preferred parameters include coercivity, hysteresis loss, Barkhausen peak amplitude and Barkhausen rms signal level.

The lifeline is of any type suitable for correlation to a particular type of coiled tubing to be later evaluated. In a preferred embodiment, however, the lifeline will be determined for a selected type of coiled tubing made of a known material and having a known nominal diameter and wall thickness of the same type as the coiled tubing to be ultimately evaluated. In determining such a lifeline, the selected coiled tubing is used in such a manner that the selected coiled tubing undergoes stress and strain in response to forces as would be encountered in using the coiled tubing at an oil or gas well. After using the selected coiled tubing, at least one test (such as one or more of those mentioned above) is performed on the selected coiled tubing to obtain an output data event. This output data event is recorded and then the foregoing steps are repeated throughout a lifetime of the selected coiled tubing so that a sequence of recorded output data events is obtained for the selected coiled tubing. This itself is repeated for a plurality of selected coiled tubings of the selected type so that a plurality of sequences of recorded output data events are obtained. The lifeline for the selected type of coiled tubing is then defined in response to the plurality of sequences of recorded output data events. This is illustrated in FIG. 5.

Figure 5:
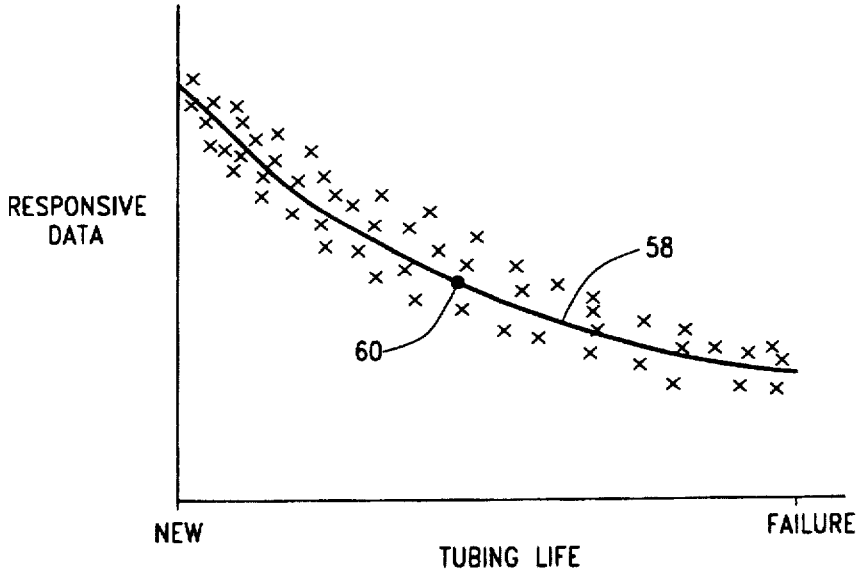
FIG. 5 is a graphical representation of a hypothetical "lifeline" for a type of coiled tubing and a hypothetical data point on the lifeline for a used coiled tubing to illustrate the method of the present invention.
Figure 5:
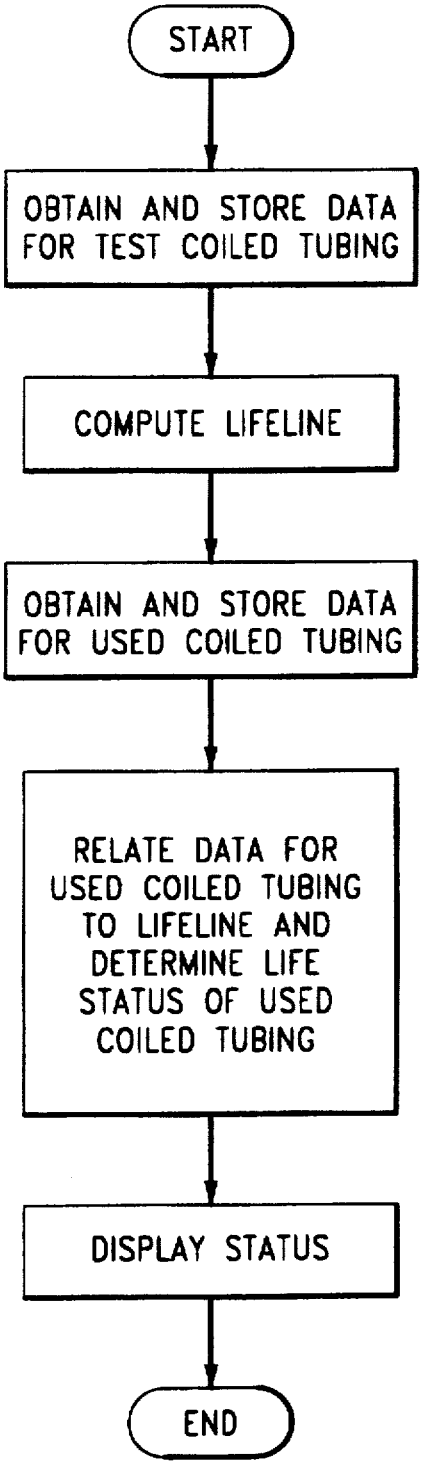

In FIG. 5, the various "x" marks exemplify individual recorded output data events for the plurality of coiled tubings of the particular type used and tested to determine the lifeline. The recorded events then can be analyzed, such as by computer and known types of curve-fitting algorithms, to define a lifeline 58 which typically is an average of the overall collection of events as depicted by the "x" marks in FIG. 5. It is to be noted that FIG. 5 is merely a hypothetical or theoretical illustration and does not represent actual data or an actual lifeline other than by coincidence.

Thus, from the foregoing, a selection of coiled tubing can be cyclicly stressed to various points in the fatigue lifetime to produce similar conditions to those actually experienced during in-situ fatigue damage as would actually occur in a well. The fatigue lifetime can be estimated by taking measurements on several samples fatigued to failure. The average fatigue lifetime is statistically based on the samples. Alternatively, a single coiled tubing can be tested in the foregoing manner over a period of use to obtain a magnetic history from which a respective lifeline would be extrapolated and used to compare with later test data obtained for the particular coiled tubing.

Test systems from which the aforementioned lifeline can be determined are known. In such systems, a coiled tubing can be fatigued to failure. Responsive data (such as from one or more of the aforementioned types of tests) is recorded either during the fatiguing process or afterwards. For example, the test coiled tubing is stored in a coiled state on a reel and the at least one test is performed at one or more portions of the test coiled tubing as the test coiled tubing is unwound from the reel. This unreeled portion of the coiled tubing can either be placed under one or more tensile, compressive or shear force as would act on coiled tubing when used at an oil or gas well or no such forces may be applied, other than any such force occurring as a result of the unwinding of the test coiled tubing. Testing of the test coiled tubing should be the same with regard to externally applied forces as are to be applied to the particular coiled tubing to be evaluated by the remainder of the method of the present invention. A specific system that can be used to determine a lifeline includes the Coiled Tubing Fatigue Test Machine developed under the 1993 CoilLIFE Joint Industry Project as modified to make the desired test measurements of the types mentioned above (e.g., Barkhausen). As another example, a lifeline can also be determined from coiled tubing used in real life or actual wellbores.

To test a particular coiled tubing once the lifeline has been established, the selected coiled tubing is subjected to the same testing as applied to the test coiled tubing(s) to the extent needed to obtain corresponding test data. The same one or more tests are performed on the selected coiled tubing whereby a specific output data event is obtained for the selected coiled tubing. For example, a particular data point such as indicated by reference numeral 60 in FIG. 5 is obtained. It is compared to the predetermined sequence of output data events represented by the lifeline 58 in FIG. 5. This is graphically illustrated in FIG. 5 by marking on the lifeline 58 the data point 60. This point is compared to the overall lifeline whereby the point of the particular coiled tubing in the overall useful life represented by the lifeline 58 is determined. This can be, for example, represented as a percentage of the horizontal scale between "new" and "failure" indicated in FIG. 5. The information obtained from this comparison is generated as a coiled tubing status indication for display through the indicator 56 shown in FIG. 4 (which could be a display of a graph of the type shown in FIG. 5).

The foregoing method and a program for implementing it through the system of FIG. 4 is set forth in FIG. 6.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of testing coiled tubing, comprising:

performing at least one test on a coiled tubing that has been subjected to cyclic plastic deformation, including obtaining a specific output data event for the coiled tubing;

comparing the specific output data event with a predetermined sequence of output data events for determining where the sequence and the specific output data event correspond; and generating a coiled tubing status indication in response to where the specific output data event corresponds with the sequence as a measure of a point in the useful life of the coiled tubing.

2. A method as defined in claim 1, wherein the predetermined sequence of output data events is obtained from the coiled tubing.

3. A method as defined in claim 1, wherein the predetermined sequence of output data events is obtained from a plurality of coiled tubings.

4. A method as defined in claim 1, wherein the at least one test includes a magnetic nondestructive evaluation test.

5. A method of testing coiled tubing, comprising:

performing at least one test on at least one test coiled tubing over at least a portion of a time period during which the test coiled tubing has been subjected to tensile, compressive and shear forces that act on coiled tubing when used at a well, wherein said at least one test provides a sequence of output data events such that the sequence correlates to a progressive degradation of the test coiled tubing;

performing the at least one test on a used coiled tubing that has been used in a well, including obtaining a specific output data event for the used coiled tubing;

comparing the specific output data event with the sequence of output data events for determining where the sequence and the specific output data event correspond; and generating a used coiled tubing status indication in response to where the specific output data event corresponds with the sequence as a measure of a point in the useful life of the used coiled tubing.

6. A method as defined in claim 5, wherein the at least one test coiled tubing is stored in a coiled state on a reel and the at least one test is performed at one or more portions of the test coiled tubing as the test coiled tubing is unwound from the reel but wherein no tensile, compressive or shear force as would act on coiled tubing when used at an oil or gas well is applied to the test coiled tubing, other than any such force occurring as a result of the unwinding of the test coiled tubing, when the test is performed on the test coiled tubing.

7. A method as defined in claim 6, wherein the used coiled tubing is stored in a coiled state on a reel and the test is performed at one or more portions of the used coiled tubing as the used coiled tubing is unwound from the reel but wherein no tensile, compressive or shear force as would act on coiled tubing when used at an oil or gas well is applied to the used coiled tubing, other than any such force occurring as a result of the unwinding of the used coiled tubing, when the test is performed on the used coiled tubing.

8. A method as defined in claim 5, wherein the at least one test coiled tubing is stored in a coiled state on a reel and the at least one test is performed at one or more portions of the test coiled tubing as the test coiled tubing is unwound from the reel and at least one tensile, compressive or shear force as would act on coiled tubing when used at an oil or gas well is applied to the test coiled tubing when the test is performed on the test coiled tubing.

9. A method as defined in claim 8, wherein the used coiled tubing is stored in a coiled state on a reel and the test is performed at one or more portions of the used coiled tubing as the used coiled tubing is unwound from the reel and at least one tensile, compressive or shear force as would act on coiled tubing when used at an oil or gas well is applied to the used coiled tubing when the test is performed on the used coiled tubing.

10. A method as defined in claim 5, wherein a plurality of test coiled tubing are tested and an average sequence of output data events is determined.

11. A method as defined in claim 5, wherein the test coiled tubing is a coiled tubing that is used repeatedly over a period of time in different oil or gas wells and a test is performed thereon after each use of the coiled tubing.

12. A method as defined in claim 5, wherein the test coiled tubing and the used coiled tubing have undergone, prior to performing the at least one test thereon, a plurality of cycles of plastic deformation.

13. A method as defined in claim 12, wherein a plurality of test coiled tubing are tested and an average sequence of output data events is determined.

14. A method as defined in claim 13, wherein the at least one test includes a magnetic nondestructive evaluation test.

15. A method as defined in claim 14, wherein the plastic deformation includes plastic strain within the range of about 0.01 to about 0.02.

16. A method of testing coiled tubing, comprising:

(a) determining a lifeline for a selected type of coiled tubing made of a known material and having a known nominal diameter and wall thickness, including:

(a1) using a selected coiled tubing of the selected type such that the selected coiled tubing undergoes stress and strain in response to forces encountered in using a coiled tubing at an oil or gas well;

(a2) after said step (a1), performing at least one nondestructive evaluation test on the selected coiled tubing to obtain an output data event;

(a3) recording the output data event;

(a4) repeating said steps (a1) through (a3) throughout a lifetime of the selected coiled tubing so that a sequence of recorded output data events is obtained for the selected coiled tubing;

(a5) repeating said steps (a1) through (a4) for a plurality of selected coiled tubings of the selected type so that a plurality of sequences of recorded output data events are obtained; and (a6) defining the lifeline for the selected type of coiled tubing in response to the plurality of sequences of recorded output data events;

(b) performing the at least one test on a coiled tubing of the selected type, including obtaining a specific output data event for the coiled tubing;

(c) comparing the specific output data event with the defined lifeline for determining where the defined lifeline and the specific output data event correspond; and (d) generating a coiled tubing status indication in response to where the specific output data event corresponds with the defined lifeline as a measure of a point in the useful life of the coiled tubing of said step (b).

17. A method as defined in claim 16, wherein the coiled tubing of step (a) and the coiled tubing of step (b) have undergone an unknown plurality of cycles of plastic deformation.

18. A method as defined in claim 17, wherein the plastic deformation includes plastic strain within the range of about 0.01 to about 0.02.

19. A method of testing coiled tubing, comprising:

performing at least one test on a coiled tubing that is moving with respect to a sensor, including obtaining a specific output data event for the coiled tubing;

comparing the specific output data event with a predetermined sequence of output data events for determining where the sequence and the specific output data event correspond; and generating a coiled tubing status indication in response to where the specific output data event corresponds with the sequence as a measure of a point in the useful life of the coiled tubing.

20. A method as defined in claim 19, wherein the predetermined sequence of output data events is obtained from the coiled tubing.

21. A method as defined in claim 19, wherein the predetermined sequence of output data events is obtained from a plurality of coiled tubings.

22. A method as defined in claim 19, wherein the at least one test includes a magnetic nondestructive evaluation test.

* * * * *